US006454435B1

(12) United States Patent
Altman

(10) Patent No.: US 6,454,435 B1
(45) Date of Patent: Sep. 24, 2002

(54) CARD-SHAPED FLASHLIGHT DEVICE WITH LAMP, FLASHER AND/OR BUZZER FEATURES

(75) Inventor: Peter Altman, Austin, TX (US)

(73) Assignee: Lumatec Industries, Inc., Austin, TX (US)

( * ) Notice: Subject to any disclaimer, the term of this patent is extended or adjusted under 35 U.S.C. 154(b) by 0 days.

(21) Appl. No.: 09/816,298

(22) Filed: Mar. 23, 2001

(51) Int. Cl.[7] ..... F21L 4/00
(52) U.S. Cl. ..... 362/200; 362/189
(58) Field of Search ..... 362/200, 201, 362/189

(56) References Cited

U.S. PATENT DOCUMENTS

| | | | | |
|---|---|---|---|---|
| 3,310,668 A | | 3/1967 | Schwartz | 240/6.4 |
| 4,085,315 A | | 4/1978 | Wolter et al. | 362/116 |
| 4,521,833 A | | 6/1985 | Wolter | 362/116 |
| 4,644,451 A | | 2/1987 | Chabria | 362/189 |
| 5,158,356 A | | 10/1992 | Guthrie | 362/188 |
| 5,457,613 A | | 10/1995 | Vandenbelt et al. | 362/200 |
| 5,475,368 A | * | 12/1995 | Collins | 362/200 X |
| 5,893,631 A | | 4/1999 | Padden | 362/201 |
| 5,927,846 A | | 7/1999 | Sinclair | 362/189 |
| 5,934,789 A | | 8/1999 | Sinclair et al. | 362/189 |
| 6,039,454 A | * | 3/2000 | Hallgrimsson | 362/200 X |
| 6,070,990 A | * | 6/2000 | Dalton et al. | 362/200 X |
| 6,109,762 A | | 8/2000 | Hallgrimsson et al. | 362/200 |
| 6,270,234 B1 | * | 8/2001 | Au-Yeung | 362/200 X |

FOREIGN PATENT DOCUMENTS

| | | | |
|---|---|---|---|
| FR | 1443787 | 12/1966 | 362/200 |

* cited by examiner

*Primary Examiner*—Laura K. Tso
(74) *Attorney, Agent, or Firm*—Flanagan & Flanagan; John R. Flanagan

(57) ABSTRACT

A card-shaped flashlight device includes a holder, a lamp module mounted on the holder, one or both of a flasher light module and a buzzer module mounted on the holder, and a planar battery attached to the holder for powering the lamp module, buzzer module and flasher module. Lamp, flasher and buzzer circuits which respectively include the lamp module, buzzer module and flasher module are connected to the battery in parallel with one another such that the lamp module, buzzer module and flasher module are actuatable by corresponding lamp switch, buzzer switch and flasher switch independently of one another.

47 Claims, 12 Drawing Sheets

CARD-SHAPED FLASHLIGHT DEVICE WITH LAMP, FLASHER AND/OR BUZZER FEATURES

BACKGROUND OF THE INVENTION

1. Field of the Invention

The present invention generally relates to portable lighting devices and, more particularly, is concerned with a card-shaped flashlight device with lamp, flasher and/or buzzer features and powered by a common power source.

2. Description of the Prior Art

Miniature portable flashlight devices which can be stored in a pocket or attached to a key chain are known in the prior art. An example of a miniature pocket flashlight is the one disclosed in U.S. Pat. No. 4,644,451 to Chabria. The Chabria miniature pocket flashlight has a hollow flexible outer case open at opposite ends, a pair of end caps closing the opposite ends of the outer case, a battery receptacle, an electric switch unit disposed in the case which is activated by squeezing the flexible case, and a lamp electrically connected and mounted to the unit and protruding through a hole in one of the end caps on the case (or alternatively the lamp is mounted to a socket in the end cap itself). At least the one end cap is removable in order to replace the lamp and batteries.

The design of the Chabria flashlight embodies at least three major drawbacks. First, the design permits light generated by the lamp to disperse in all possible radial directions from the lamp thus reducing the amount of light projected by the lamp on any one desired location. Second, the design requires that the lamp extend through a hole or from a socket in the end cap of the case. This design requirement leaves the lamp unprotected, exposing it to frequent impacts with extraneous objects while the flashlight is being handled and carried by the user. Such impacts are likely to soon cause breakage of the lamp filament and result in malfunction and premature shortening of the useful life of the lamp. Third, the design requires that one or both of the end caps of the case be frictionally fitted to the ends of the case so as to be readily removable to replace the lamp and batteries. Over time such frictional fit tends to loosen up and allow the parts of the flashlight to come apart. This increases the risk of losing an end cap which would then require the replacement of the flashlight itself.

A thin card-like flashlight device disclosed in U.S. Pat. No. 5,457,613 owned by Lumatec Industries, Inc. of Austin, Tex., and marketed under the trademark FLASHCARD, provides a functional and reliable design which overcomes the aforementioned drawbacks of the pocket flashlight design of the Chabria patent. The Lumatec flashlight device provides a package which is relative thin and flat, has a card-like appearance and handles and feels similar to a credit card with which users are familiar. The Lumatec flashlight device provides a highly fashionable appearance as well as providing the lighting function in a highly reliable way in terms of projecting a beam of light toward a desired location and protecting all parts in a peripherally sealed outer protective cover.

In order for the advantages and benefits of the highly commercially successful Lumatec flashlight device to be enjoyed by an even wider range of users, the inventor(s) herein have perceived a need for incorporation of other functional features in this flashlight device which will provide users with other useful and desirable benefits.

SUMMARY OF THE INVENTION

The present invention provides a card-shaped flashlight device with lamp, flasher and/or buzzer features and powered by a common power source, which flashlight device is thus designed to satisfy the aforementioned need.

Accordingly, the present invention is directed to a card-shaped flashlight device which comprises: (a) a battery of a generally planar configuration and having a pair of opposite faces and a pair of electrical terminals of opposite polarities mounted on one of the opposite faces; (b) a holder having a generally planar configuration, a front edge, a rear edge spaced from the front edge, a pair of opposite surfaces, means for receiving and holding the battery along one of the opposite surfaces of the holder and an interior edge defining a slot recessed into the holder from the front edge thereof; (c) a reflector at least partly disposed in the slot of the holder and interfitted on the interior edge of the holder and having top and bottom portions which protrude in opposite directions outwardly beyond the opposite surfaces of the holder; (d) a lamp mounted within the reflector; (e) a lamp switch mounted on the holder and actuatable between on and off conditions; and (f) means for forming a lamp circuit which includes the lamp, the terminals of the battery and the lamp switch such that the lamp projects a generally spotlight beam shaped by the reflector in response to actuation of the lamp switch.

The flashlight device of the present invention also comprises means for enclosing the holder, the battery, the lamp switch and the reflector in a sealed pouch which permits actuation of the lamp switch from, and projection of the spotlight beam to, the exterior of the device.

The flashlight device of the present invention further comprises: a flasher module mounted on the holder between the slot and the rear edge of the holder; a flasher switch actuatable between on and off conditions; and means for forming a flasher circuit which includes the flasher module, the terminals of the battery and the flasher switch such that the flasher module generates a blinking light beam in response to actuation of the flasher switch.

The flashlight device of the present invention still further comprises: a buzzer module mounted on the holder between the flasher module and the rear edge of the holder; a buzzer switch actuatable between on and off conditions; and means for forming a buzzer circuit which includes the buzzer module, the terminals of the battery and the buzzer switch such that the buzzer module generates a sound in response to actuation of the buzzer switch. The buzzer circuit is connected to the battery in parallel with the flasher circuit and the lamp circuit such that the buzzer module, the lamp and the flasher module are operable independently of one another by actuation of the corresponding buzzer switch, lamp switch and flasher switch independently of one another.

The present invention also is directed to a card-shaped flashlight device which comprises: (a) a holder; (b) a lamp module mounted on the holder; (c) a flasher light module mounted on the holder; (d) a buzzer module mounted on the holder; (e) a planar battery attached to the holder for powering the lamp module, buzzer module and flasher module; and (f) lamp, flasher and buzzer circuits which respectively include a lamp switch and the lamp module, a buzzer switch and the buzzer module and a flasher switch and the flasher module being connected to the battery in parallel relationships with one another such that the lamp module, buzzer module and flasher module are operable independently of one another by the actuation of the corresponding lamp switch, buzzer switch and flasher switch independently of one another.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
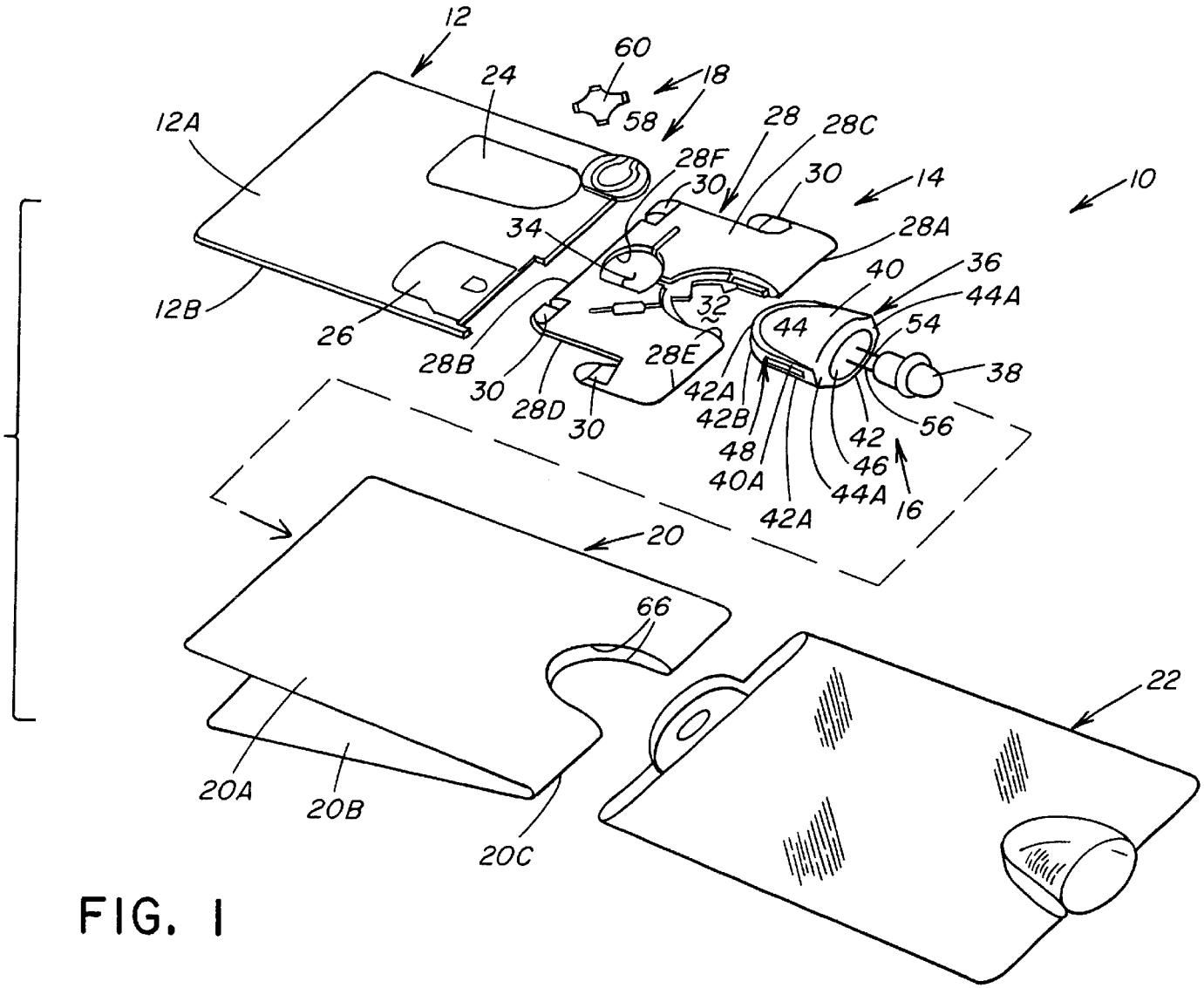
FIG. 1 is an exploded perspective view of a first embodiment of a card-shaped flashlight device of the present invention incorporating a holder, a planar battery, a first lamp module, a lamp switch, a cover and an outer protective enclosure.

Referring to the drawings and particularly to FIGS. 1 to 8, there is illustrated a first embodiment of the card-shaped flashlight device of the present invention, generally designated 10. Basically, the card-shaped flashlight device 10 includes a battery 12, a holder 14, a lamp module 16 and a lamp switch 18. Also, the flashlight device 10 includes a cover 20 and an outer protective enclosure 22.

The battery 12 of the first embodiment of the flashlight device 10 is of a thin planar configuration and can be one that is marketed by Polaroid Corporation. Preferably, the battery 12 is a power source that supplies approximately 6 VDC. The planar battery 12 has opposite front and rear faces 12A, 12B and a pair of electrical terminals 24, 26 of opposite polarities mounted on the front face 12A.

The holder 14 of the first embodiment of the flashlight device 10 can be a rigid plastic component manufactured by using conventional injection molding techniques. The holder 14 includes a flat main panel portion 28 having a planar configuration and a front edge 28A, a rear edge 28B spaced from the front edge 28A and opposite front and rear surfaces 28C, 28D. The holder 14 also includes means in the form of a plurality of spaced tab portions 30 connected to the main panel portion 28 at plural locations thereon spaced apart from one another and from the front edge 28A and extending from the main panel portion 28 into offset positions with respect to the rear surface 28D of the main panel portion 28 so as to receive, clip and hold the planar battery 12 at edge portions thereof between the main panel portion 28 and tab portions 30 and generally along the rear surface 28D of the main panel portion 28. The main panel portion 28 also has an interior edge 28E defining a slot 32 recessed therein from the front edge 28A toward the rear edge 28B thereof. The main panel portion 28 further has a continuous edge 28F defining an opening 34 through the main panel portion 28 which is located between and spaced from the slot 32 and the rear edge 28B thereof.

The lamp module 16 of the first embodiment of the flashlight device 10 includes a reflector 36 and a first lamp 38, preferably in the form of a lens end krypton bulb. The reflector 36 is partly disposed in the slot 32 of the flat panel portion 28 of the holder 14 and interfitted on the interior edge 28E thereof. The reflector 36 has top and bottom portions 40, 42 which protrude in opposite directions outwardly beyond the front and rear surfaces 28C, 28D of the flat panel portion 28 of the holder 14. The top and bottom portions 40, 42 have opposite convex configurations and together form an annular front portion 44 defining an oval-shaped front opening 46 and opposite side portions 40A, 42A defining a U-shaped peripheral channel 48 extending between opposite ends 44A of the front portion 44 along the opposite side portions 40A, 42A to rear end portions 40B, 42B. The side and rear end portions 40A, 40B and 42A, 42B of the top and bottom portions 40, 42 of the reflector 36 defining the U-shaped peripheral channel 48 interfit over the interior edge 28E of the main panel portion 28 such that the reflector 36 thereby seats on the opposite front and rear surfaces 28C, 28D of the main panel portion 28 of the holder 14 along the interior edge 28E and within the slot 32 and through the front edge 28A thereof. The reflector 36 also has an interior wall portion 50 connected to and extending transversely between the top and bottom portions 40, 42 of the reflector 36 at a location intermediately between the front opening 46 and the rear end portions 40B, 42B of the reflector 36. The interior wall portion 50 has a hole 52 defined therethrough with the first lamp 38 mounted within the reflector 36 by being seated through the hole 52 in the interior wall portion 50 of the reflector 36 and thus supported within the reflector 36 by the wall portion 50. The first lamp 38 also has a pair of electrical leads 54, 56 extending rearwardly therefrom and of the wall portion 50.

The lamp switch 18 of the first embodiment of the flashlight device 10 is mounted on the flat panel portion 28 of the holder 14 and actuatable between on and off conditions. More particularly, the lamp switch 18 has a stationary contact portion 58 and a movable contact portion 60 adapted to be actuated in order to make electrical contact with the stationary contact element 58. The stationary contact portion 58 is preferably a printed circuit board contact which is seated on the continuous edge 28F of the main panel portion 28 and extends across the opening 34 therethrough and is disposed between the reflector 36 and the rear edge 28B of the main panel portion 28. The movable contact portion 60 is preferably a dome-shaped push contact which is seated upon the printed circuit board contact.

Figure 8:
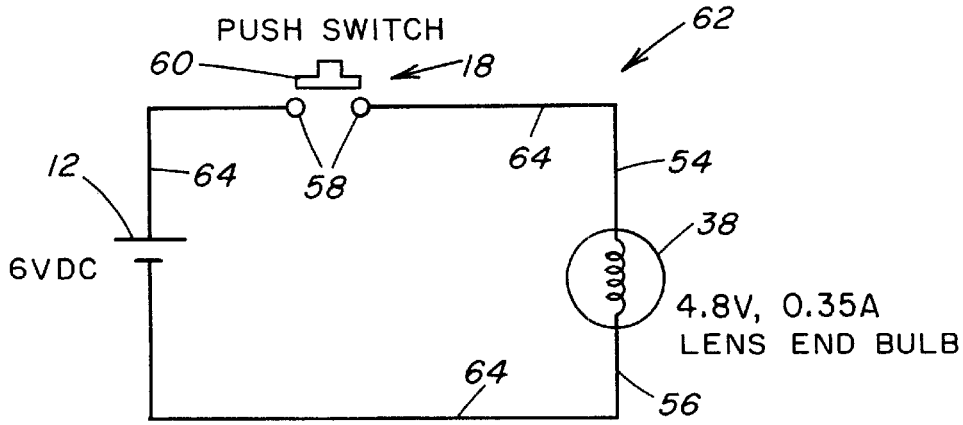
FIG. 8 is a schematic electrical diagram of the first embodiment of flashlight device of FIGS. 1 and 2.
Figure 5:
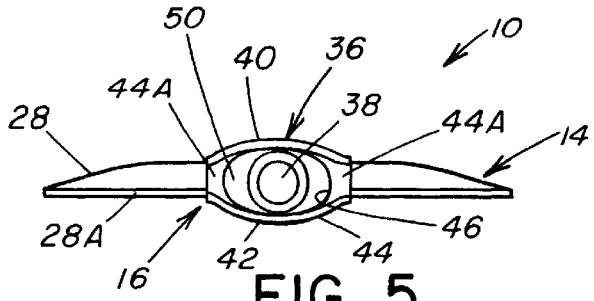
FIG. 5 a front elevational view of the subassembly as seen along line 5—5 of FIG. 4.
Figure 4:
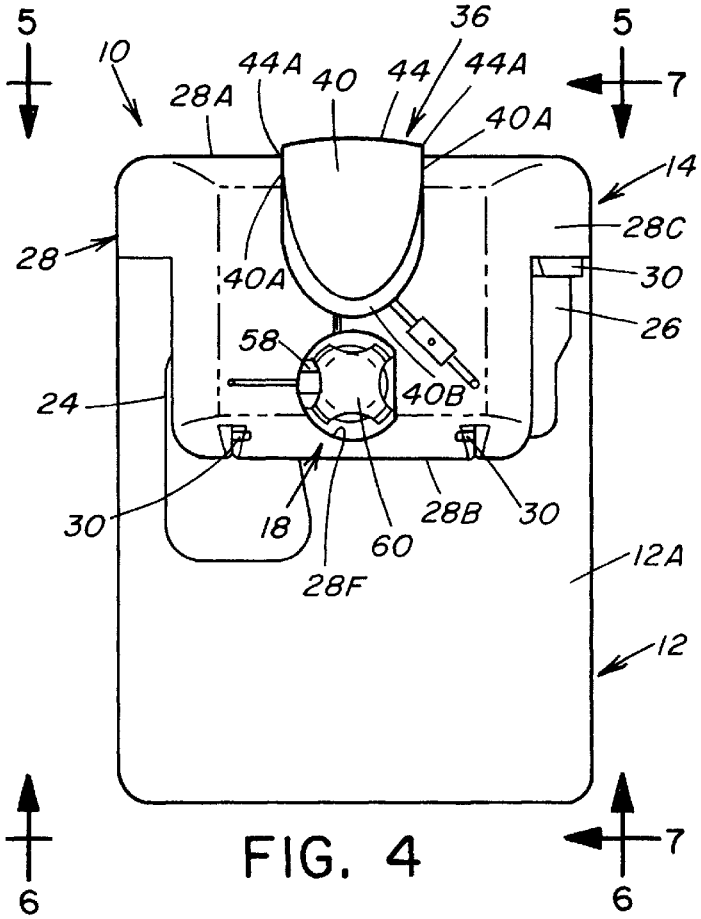
FIG. 4 is a top plan view of an assembled light generating subassembly of the flashlight device of FIG. 1 without the cover and outer protective enclosure.
Figure 7:
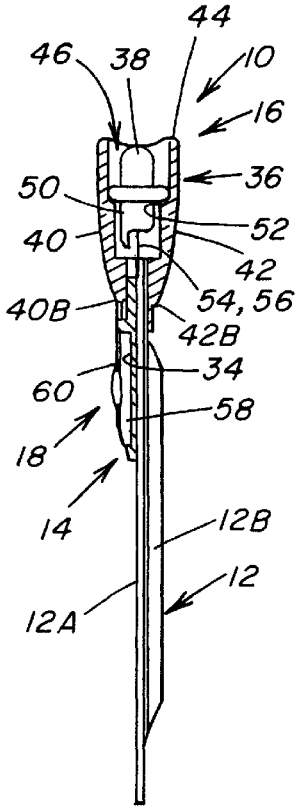
FIG. 7 is a longitudinal sectional view of the subassembly taken along line 7—7 of FIG. 4.
Figure 6:
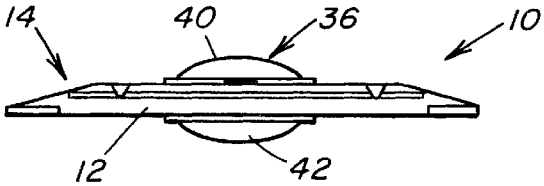
FIG. 6 is a rear elevational view of the subassembly as seen along line 6—6 of FIG. 4.
Figure 9:
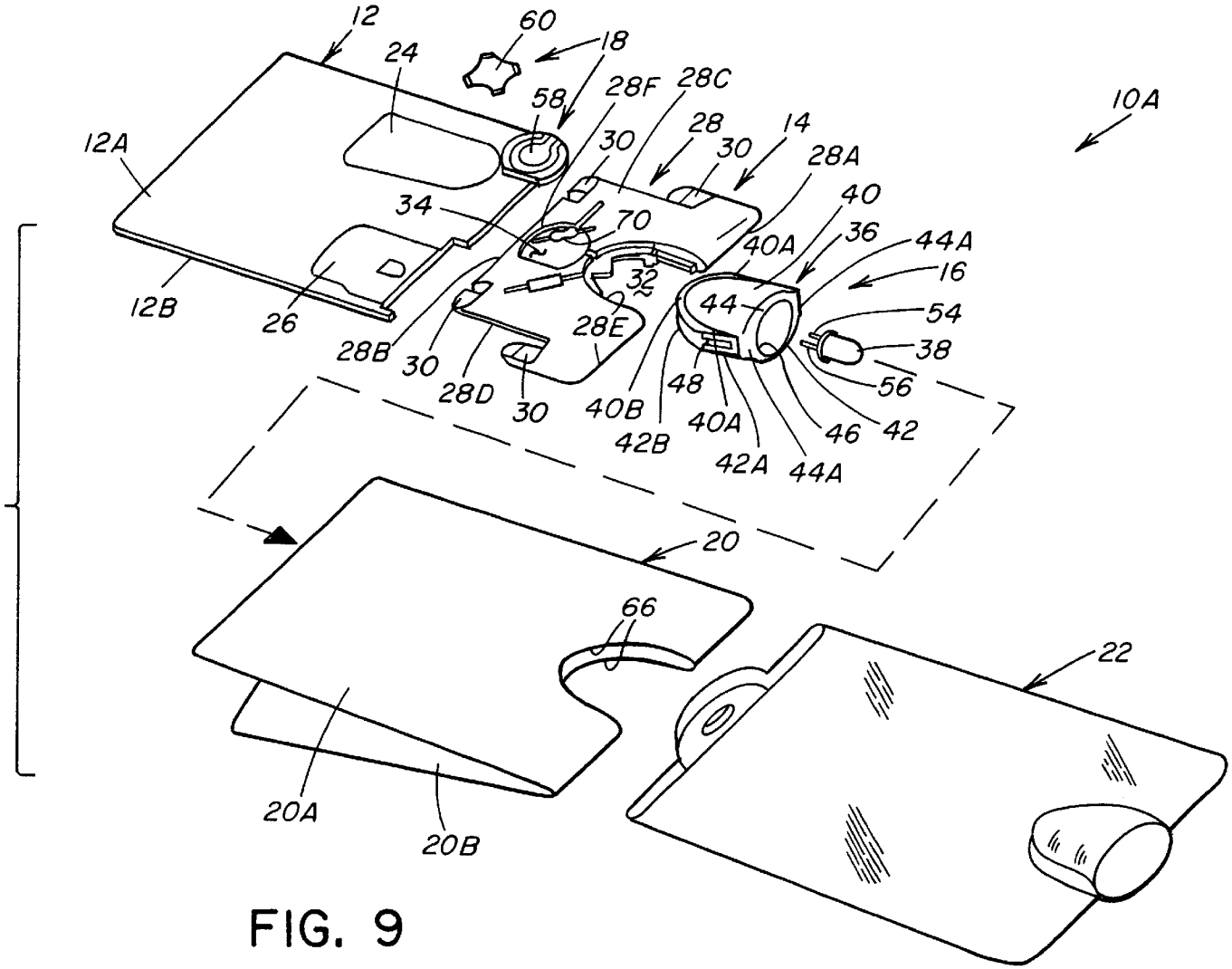
FIG. 9 is an exploded perspective view of a second embodiment of a card-shaped flashlight device of the present invention incorporating the holder, the planar battery, a second lamp module, the lamp switch, the cover, and outer protective enclosure.
Figure 11:
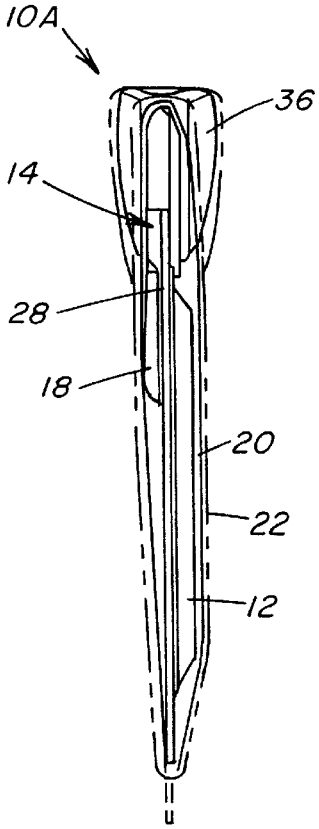
FIG. 11 is a side elevational view of the flashlight device as seen along line 11—11 of FIG. 10.
Figure 10:
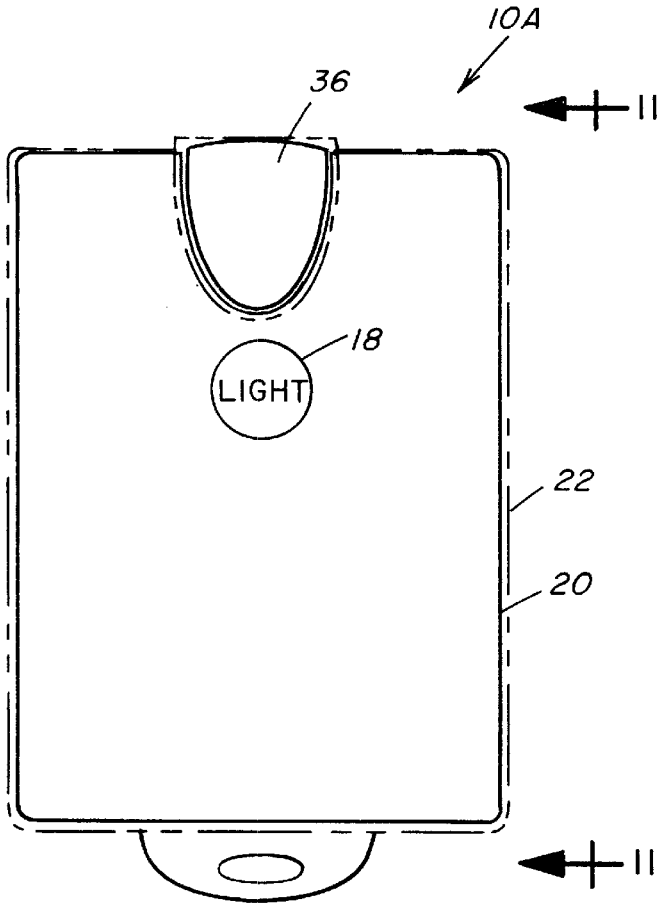
FIG. 10 is an assembled top plan view of the flashlight device of FIG. 9.
Figure 16:
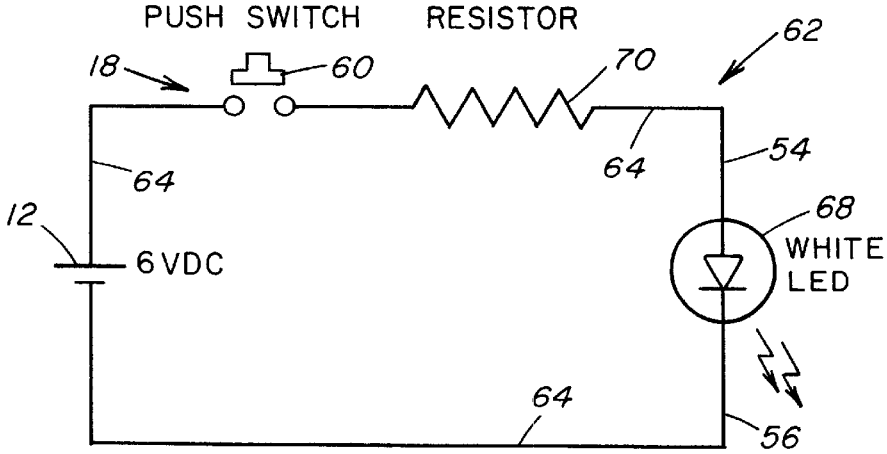
FIG. 16 is a schematic electrical diagram of the second embodiment of flashlight device of FIGS. 9 and 10.
Figure 13:
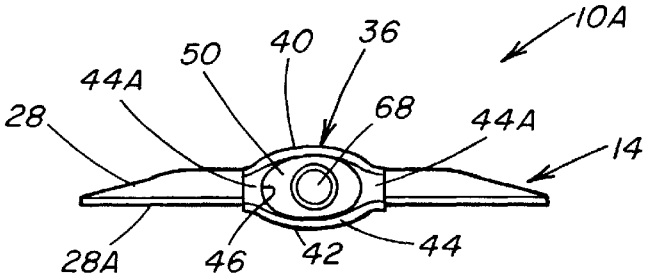
FIG. 13 is a front elevational view of the subassembly as seen along line 13—13 of FIG. 12.
Figure 12:
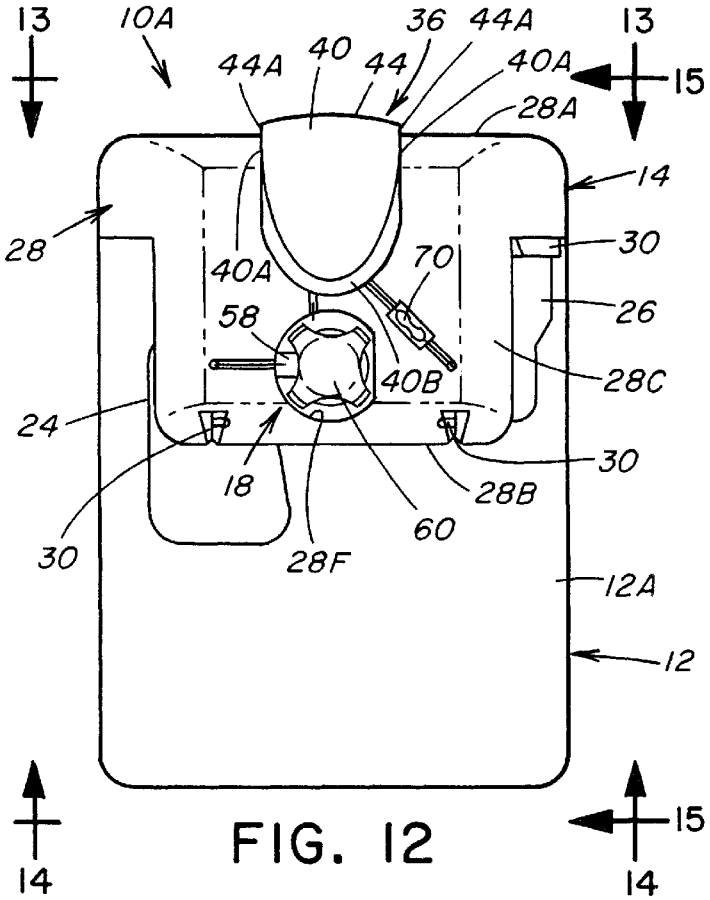
FIG. 12 is a top plan view of an assembled light generating subassembly of the flashlight device of FIG. 9 without the cover and outer protective enclosure.
Figure 15:
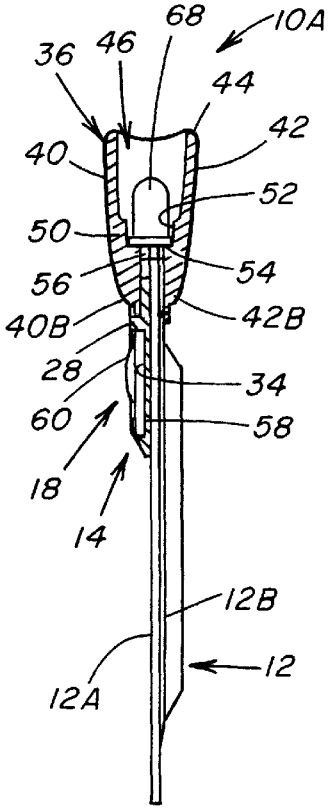
FIG. 15 is a longitudinal sectional view of the subassembly taken along line 15—15 of FIG. 12.
Figure 14:
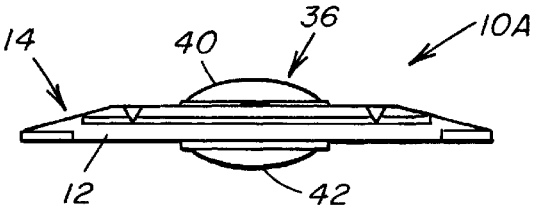
FIG. 14 is a rear elevational view of the subassembly as seen along line 14—14 of FIG. 12.
Figure 17:
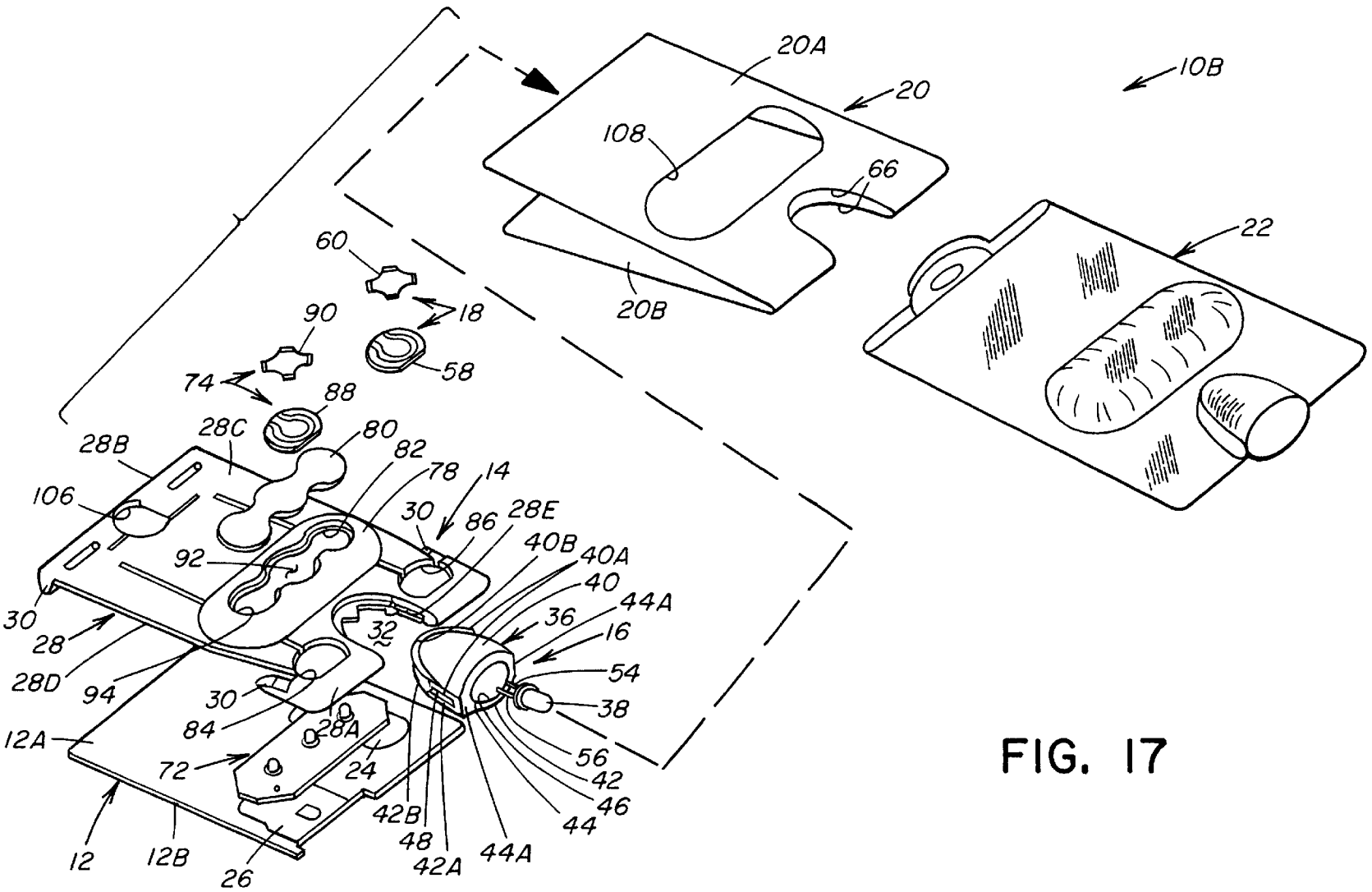
FIG. 17 is an exploded perspective view of a third embodiment of a card-shaped flashlight device of the present invention incorporating the holder, the planar battery, the second lamp module, the lamp switch, a flasher module, a flasher switch, the cover and outer protective enclosure.
Figure 19:
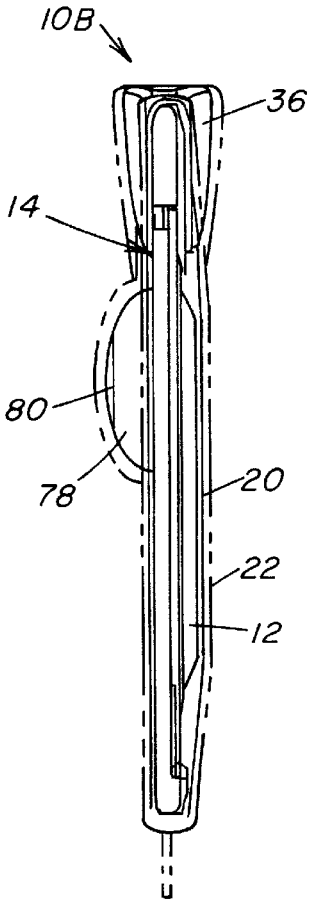
FIG. 19 is a side elevational view of the flashlight device as seen along line 19—19 of FIG. 18.
Figure 18:
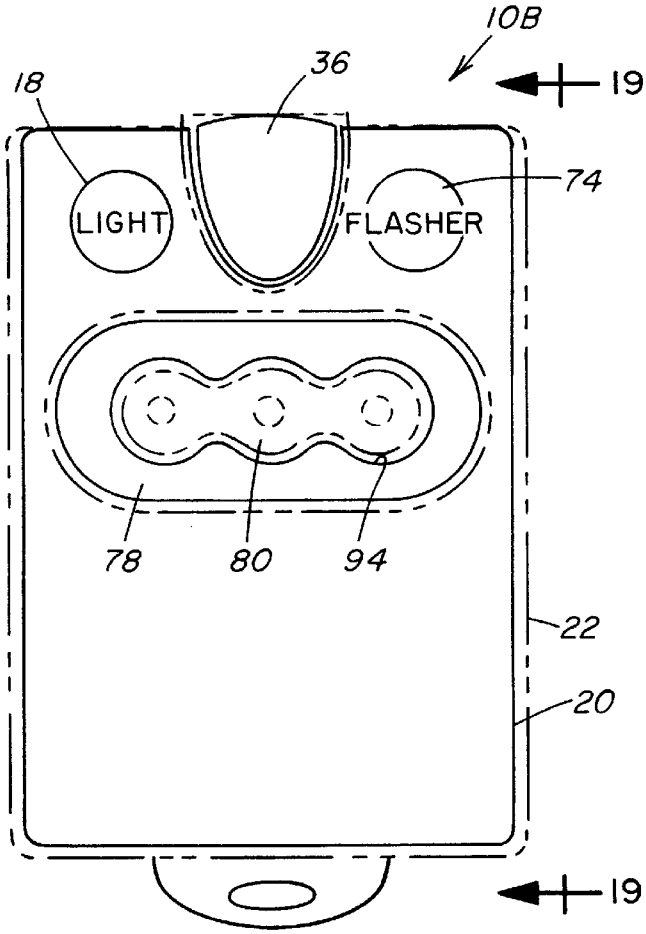
FIG. 18 is an assembled top plan view of the flashlight device of FIG. 17.
Figure 24:
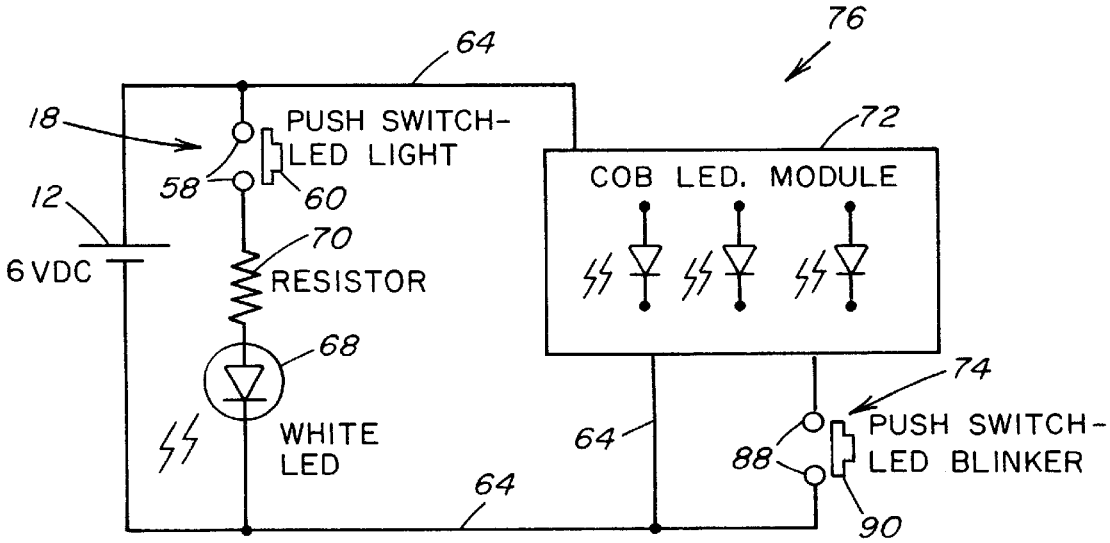
FIG. 24 is a schematic electrical diagram of the third embodiment of flashlight device of FIGS. 17 and 18.
Figure 21:
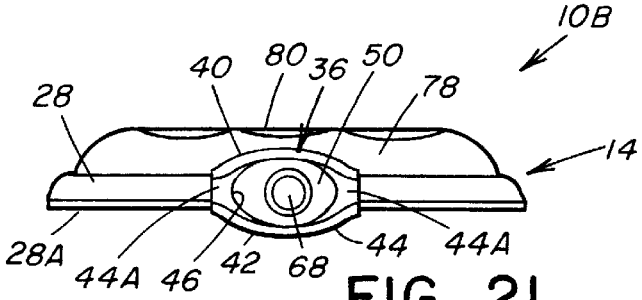
FIG. 21 a front elevational view of the subassembly as seen along line 23—23 of FIG. 20.
Figure 20:
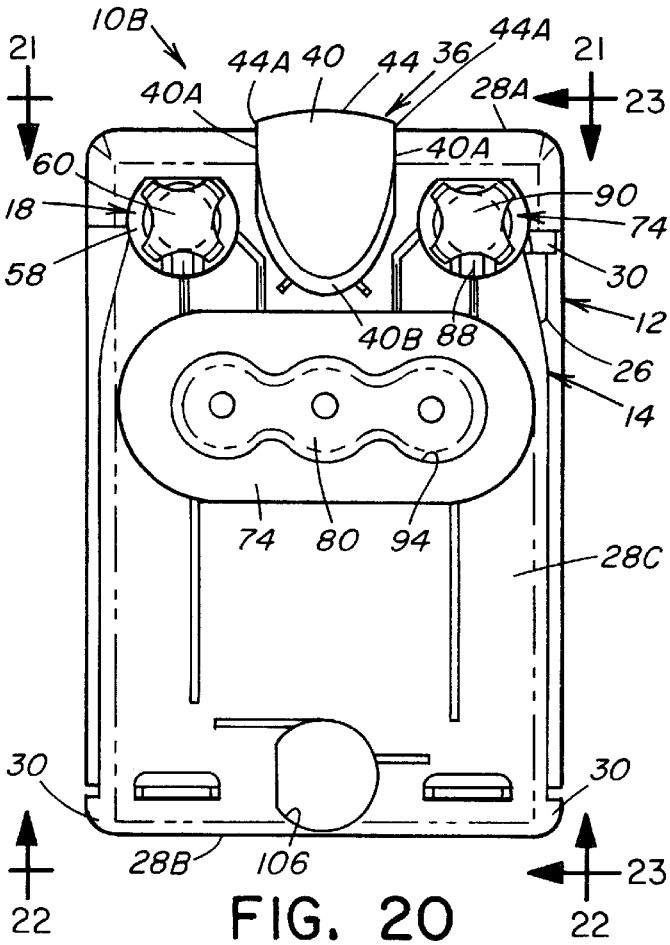
FIG. 20 is a top plan view of an assembled light generating subassembly of the flashlight device of FIG. 17 without the cover and outer protective enclosure.
Figure 23:
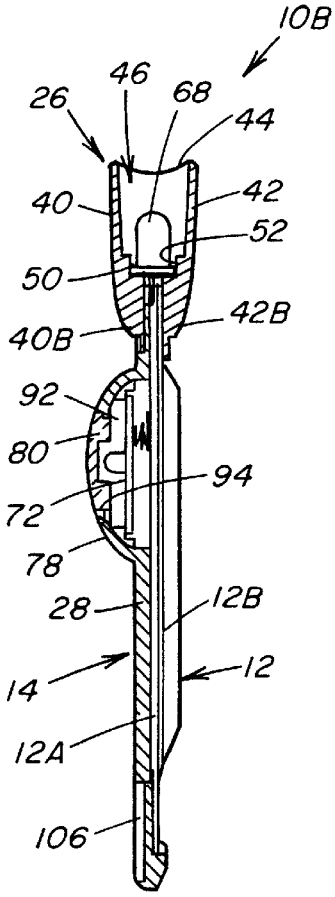
FIG. 23 is a longitudinal sectional view of the subassembly taken along line 23—23 of FIG. 20.
Figure 22:
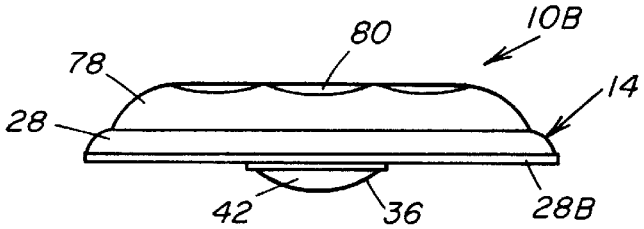
FIG. 22 is a rear elevational view of the subassembly as seen along line 22—22 of FIG. 20.
Figure 25:
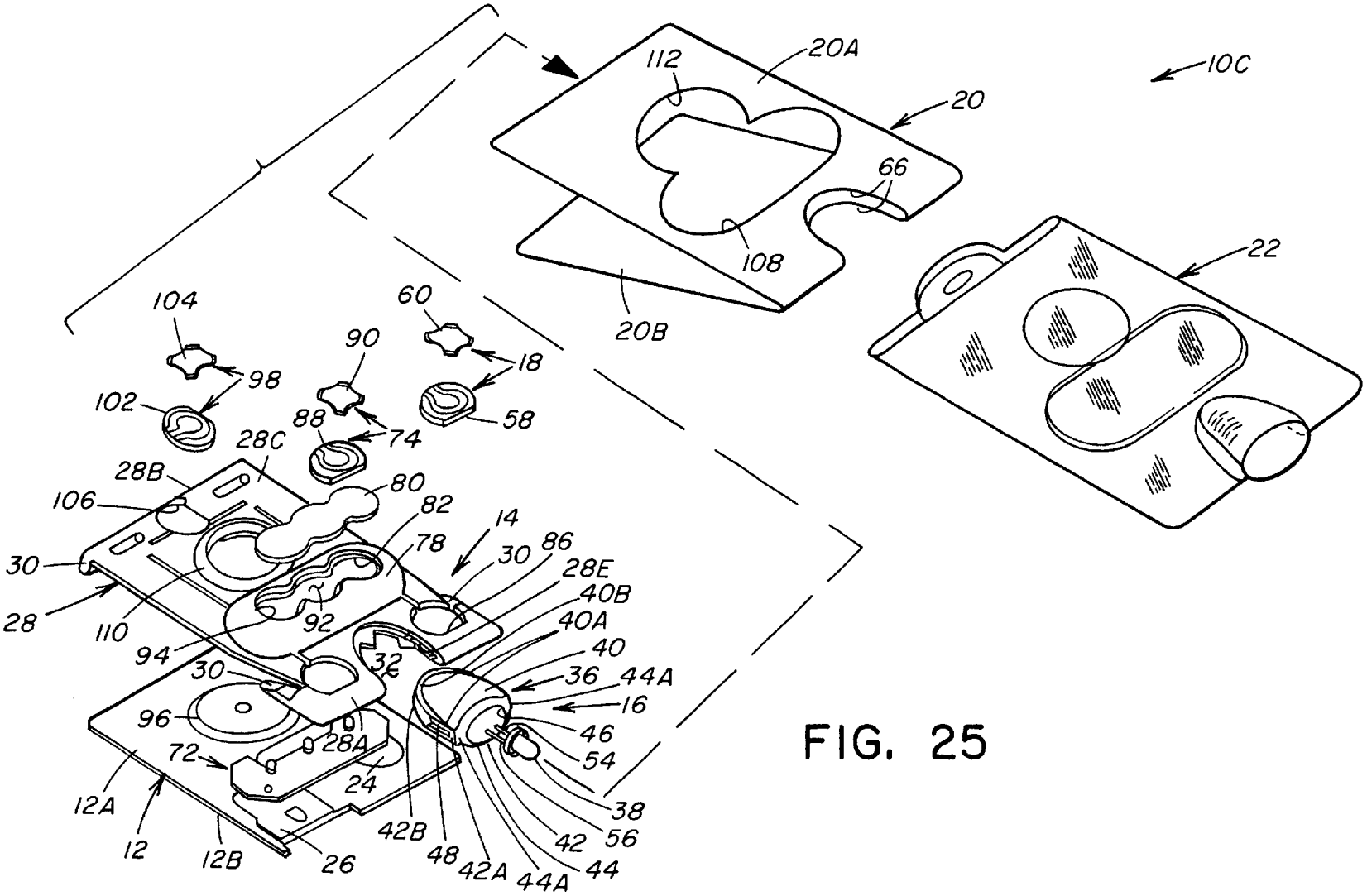
FIG. 25 is an exploded perspective view of a fourth embodiment of a card-shaped flashlight device of the present invention incorporating the holder, the planar battery, the second lamp module, the lamp switch, the flasher module, the flasher switch, a buzzer module, a buzzer switch, the cover and outer protective enclosure.
Figure 27:
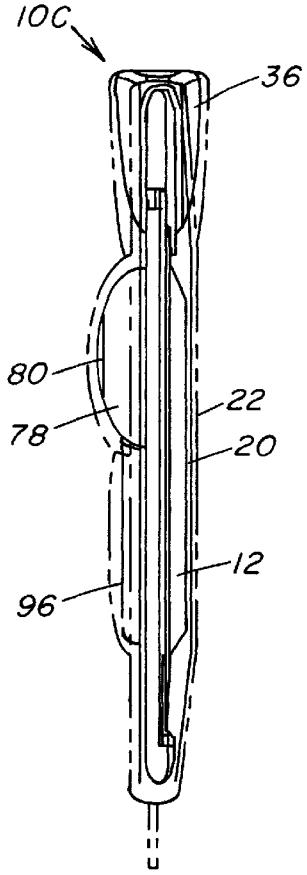
FIG. 27 is a side elevational view of the flashlight device as seen along line 27—27 of FIG. 26.
Figure 26:
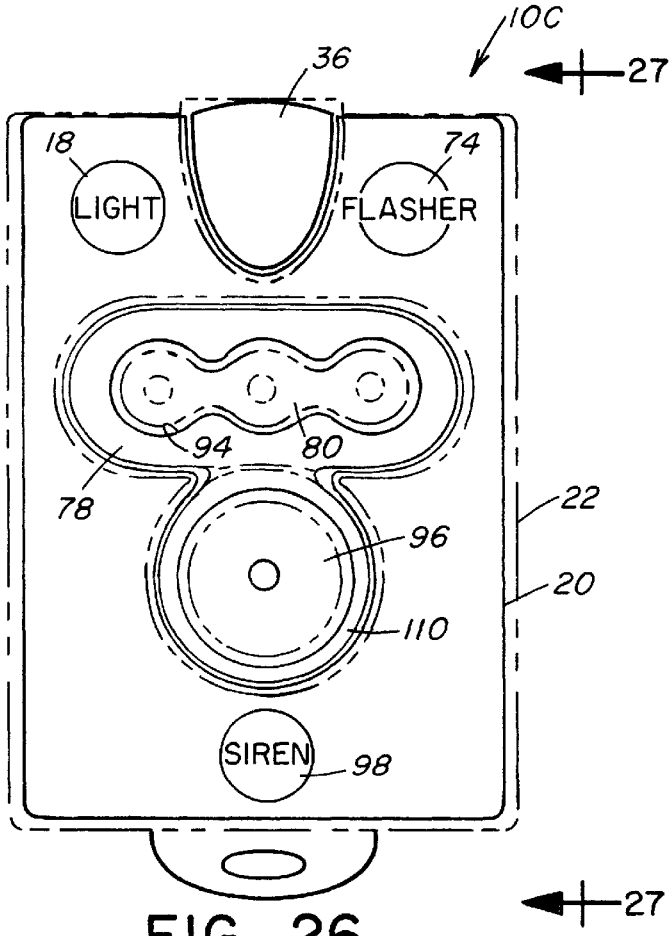
FIG. 26 is an assembled top plan view of the flashlight device of FIG. 25.
Figure 32:
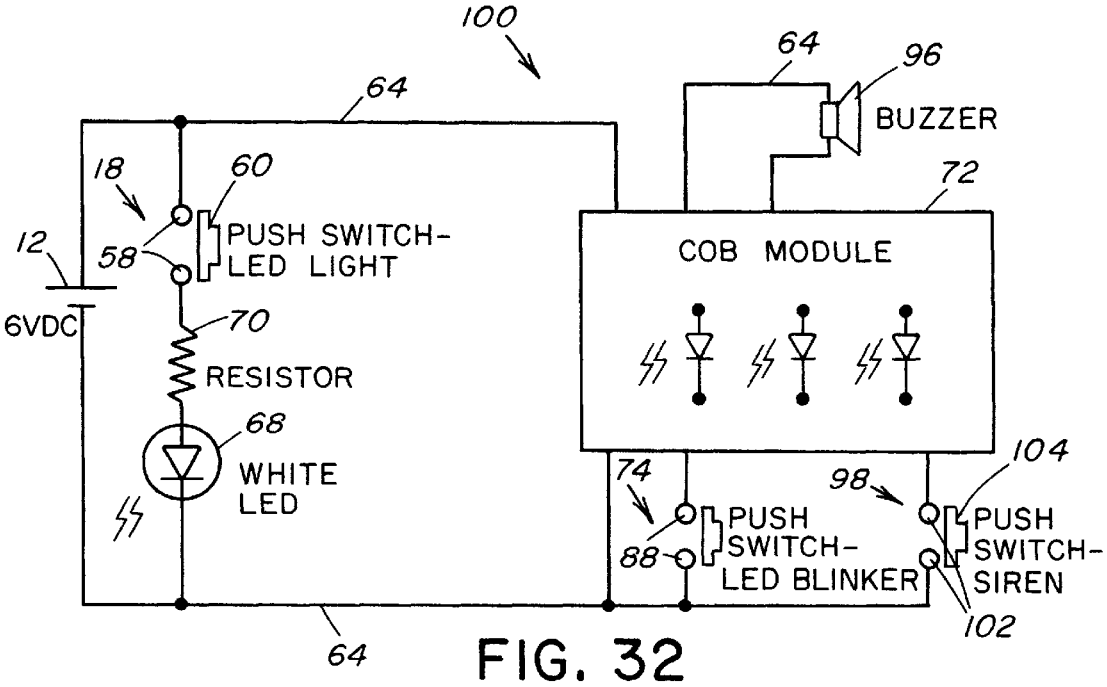
FIG. 32 is a schematic electrical diagram of the fourth embodiment of flashlight device of FIGS. 25 and 26.
Figure 29:
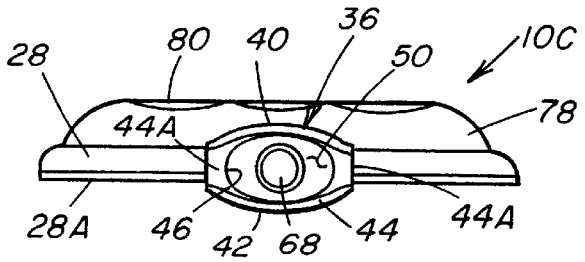
FIG. 29 a front elevational view of the subassembly as seen along line 29—29 of FIG. 28.
Figure 28:
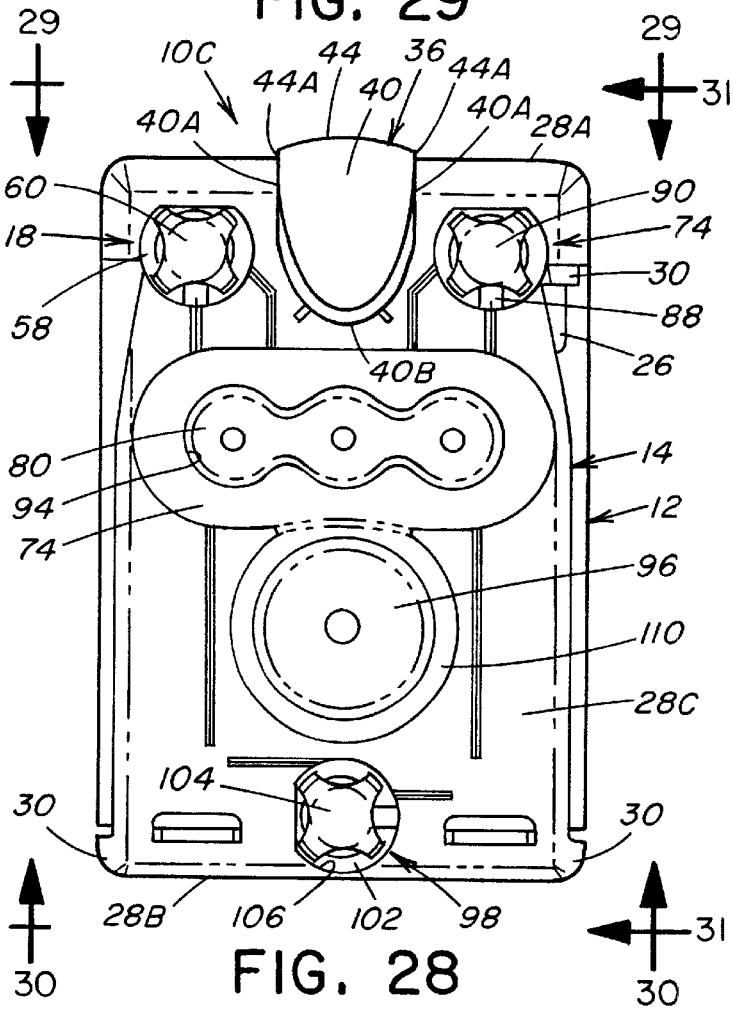
FIG. 28 is a top plan view of an assembled light generating subassembly of the flashlight device of FIG. 25 without the cover and outer protective enclosure.
Figure 31:
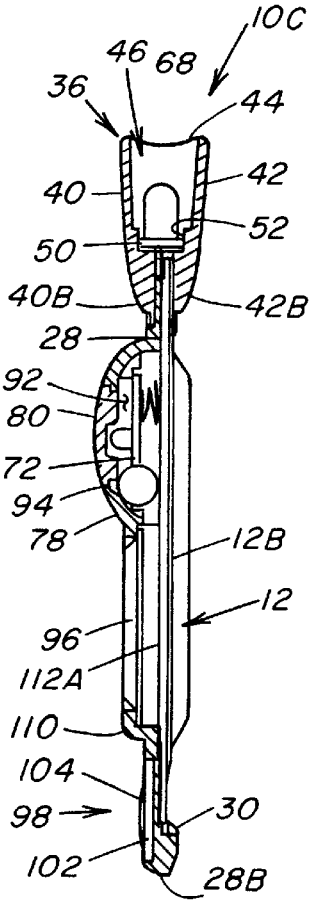
FIG. 31 is a longitudinal sectional view of the subassembly taken along line 31—31 of FIG. 28.
Figure 30:
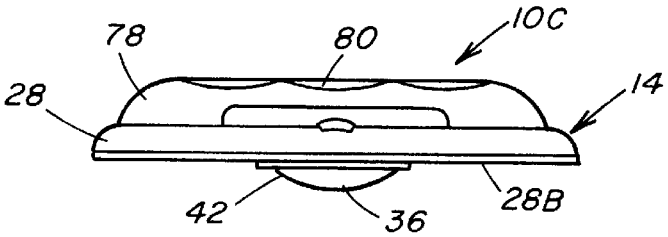
FIG. 30 is a rear elevational view of the subassembly as seen along line 30—30 of FIG. 28.

As seen schematically in FIG. 8, in the first embodiment of the flashlight device 10, an electrical lamp circuit 62 is formed between the electrical leads 54, 56 of the first lamp 38, the electrical terminals 24, 26 of the battery 12, the stationary and movable contact portions 58, 60 of the lamp switch 18 and a plurality of electrical wires 64 which electrically interconnect these components such that the first lamp 38 will generate and project a generally spotlight beam shaped by the reflector 36 in response to actuation of the lamp switch 18 between its on and off conditions. The lamp switch 18 is preferably a momentary-type switch where the first lamp 38 generates the beam as long as the movable contact portion 60 of the lamp switch 18 is held or pressed against the stationary contact portion 58.

Figure 3:
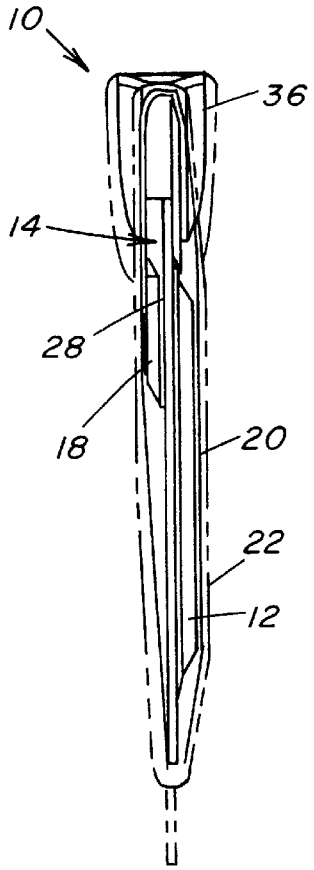
FIG. 3 is a side elevational view of the flashlight device as seen along line 3—3 of FIG. 2.
Figure 2:
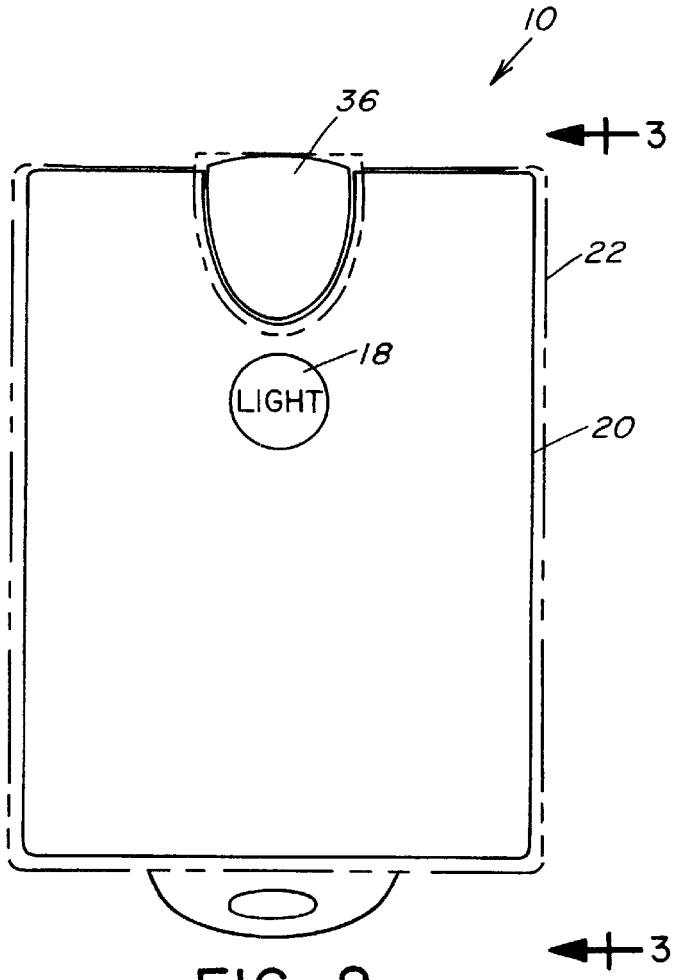
FIG. 2 is an assembled top plan view of the flashlight device of FIG. 1.

Lastly, in the first embodiment of the flashlight device 10, the battery 12 and the holder 14 are covered by the cover 20 and the battery 12, the holder 14, the lamp switch 18 and the reflector 36 are enclosed by the outer protective enclosure 22, such as made of vinyl, so as to provide a water-tight sealed pouch which permits the actuation of the lamp switch 18 from, and projection of the spotlight beam of illumination to, the exterior of the device 10. The cover 20 is in the form of a card adapted to have graphical design and/or information imprinted thereon and being folded upon itself so as to define a pair of top and bottom sheets 20A, 20B that overlie the opposite faces 12A, 12B of the battery 12 and the opposite surfaces 28C, 28D of the main panel portion 28 of the holder 14 and meet one another and are connected together to provide a folded edge 20C. The cover 20 has an opening 66 defined in the top and bottom sheets 20A, 20B which intersects the folded edge 20C for receiving the reflector 36 therethrough such that the top and bottom portions 40, 42 of the reflector 36 project respectively above and below the top and bottom sheets 20A, 20B of the cover 20. The cover 20 also has the position of the lamp switch 18 printed thereon. The outer protective enclosure 22, shown by dashed lines in FIGS. 2 and 3, is made of a transparent material, such as vinyl, and extends over the top and bottom sheets 20A, 20B of the cover 20 and the reflector 36 so as to provide a sealed pouch which overlies and encloses the battery 12, the holder 14, the reflector 36, the first lamp 38, the lamp switch 18, and the conductor wires 64.

Referring to FIGS. 9 to 16, there is illustrated a second embodiment of the card-shaped flashlight device of the present invention, generally designated 10A. The device 10A of the second embodiment of the present invention includes all of the components of the device 10 of the first embodiment of the present invention except that the lamp module 16 now utilizes a second lamp 68, being preferably a white LED, instead of the first lamp 28, being preferably the lens end krypton bulb. The planar battery 12 used in all embodiments of the present invention supplies approximately 6 volts. The second lamp 68 only utilizes approximately 4.5 volts. Therefore, the lamp circuit 62 in the third embodiment of the present invention also includes a resistor 70 connected in series with the battery 12 and the second lamp 68 to function to step down the approximately 6 volts supplied by the battery 12 to the approximately 4.5 volts used by the second lamp 68.

Referring to FIGS. 17 to 24, there is illustrated a third embodiment of the card-shaped flashlight device of the present invention, generally designated 10B. The third embodiment of the device 10B of the present invention includes all of the components of the device 10A of the second embodiment of the present invention. In addition thereto, the device 10B also includes a flasher module 72, a flasher switch 74, a flasher circuit 76, a convex-shaped dome 78 and a lens 80. The flasher module 72 of the third embodiment of the present invention is preferably a printed circuit board assembly with three red LEDs mounted thereon. The flasher module 72 is disposed in an opening 82 formed in the main panel portion 28 of the holder 14 and extends outwardly from the front surface 28C of the main panel portion 28 between the slot 32 and the rear edge 28B of the main panel portion 28.

The flasher switch 74 and the lamp switch 18 are mounted on the main panel portion 28 in respective openings 84, 86 formed in the main panel portion 28 adjacent to the front edge 28A thereof and on opposite lateral sides of the slot 32. The flasher switch 74 is actuatable or pressed between on and off conditions. The flasher switch 74 has a stationary contact portion 88 and a movable contact portion 90 adapted to be actuated in order to make electrical contact with the stationary contact element 88. The stationary contact portion 88 is preferably a printed circuit board contact which is seated in the opening 84 of the main panel portion 28. The movable contact portion 90 is preferably a dome-shaped push contact which is seated upon the printed circuit board contact or stationary contact portion 88.

The flasher circuit 76 includes the flasher module 72, the terminals 24, 26 of the battery 12 and the stationary and movable contact portions 88, 90 of the flasher switch 74 such that the flasher module 72 generates a blinking light beam in response to actuation of the flasher switch 74 from the off to on condition. The flasher module 72 ceases generation of the blinking light in response to another actuation of the flasher switch 74 from the on to off condition. The flasher circuit 76 is connected to the battery 12 in parallel with the lamp circuit 62 such that the flasher module 76 and the lamp circuit 62 are operable independently of one another by actuation of the corresponding flasher switch 74 and lamp switch 18 independently of one another.

The convex-shaped dome 78 is mounted on front surface 28C of the flat main panel portion 28 of the holder 14 between the slot 32 and the rear edge 28B of the flat main panel portion 28. The dome 78 defines a cavity 92 between the dome 78 and the main panel portion 28 of the holder 14. The dome 78 has a top opening 94 in communication with the cavity 92. The lens 80 is mounted to the dome 78 across the top opening 94 therein such that the flasher module 72 is disposed in the cavity 92 between the lens 80 on the dome 78 and the main panel portion 28 where the blinking light illuminates through the lens 80 on the dome 78 to the exterior.

The cover 20 has the positions of the flasher switch 74 and the lamp switch 18 printed thereon. The cover 20 further has an opening 108 for accommodating and exposing the dome 78.

Referring to FIGS. 25 to 32, there is illustrated a fourth embodiment of the card-shaped flashlight device of the present invention, generally designated 10C. The fourth embodiment of the device 10C of the present invention includes all of the components of the device 10B of the third embodiment of the present invention. In addition thereto, the device 10C includes a siren or buzzer module 96, a buzzer switch 98 and a buzzer circuit 100. The buzzer module 96 is mounted on the front surface 28C of the main panel portion 28 of the holder 14 between the flasher module 72 and dome 78 on one side and the rear edge 28B of the main panel portion 28 of the holder 14 on the other side. The buzzer switch 98 is actuatable or pressed between on and off conditions. The buzzer switch 98 has a stationary contact portion 102 and a movable contact portion 104 adapted to be actuated in order to make electrical contact with the stationary contact element 102. The stationary contact portion 102 is preferably a printed circuit board contact which is seated in an opening 106 of the main panel portion 28 adjacent to the rear edge 28B thereof. The movable contact portion 104 is preferably a dome-shaped push contact which is seated upon the printed circuit board contact or stationary contact portion 102. The buzzer circuit 100 includes the buzzer module 96, the terminals 24, 26 of the battery 12 and the stationary and movable contact portions 102, 104 of the buzzer switch 98 such that the buzzer module 96 generates a sound, preferably very loud and piercing in nature, in response to actuation of the buzzer switch 98 from the off to on condition. The buzzer module 96 ceases generation of the sound in response to actuation of the buzzer switch 98 from the on to off condition. The buzzer circuit 100 is connected to the battery 12 in parallel with the flasher circuit 76 and the lamp circuit 62 such that the buzzer module 96, the lamp 38 and the flasher module 72 are operable independently of one another by actuation of the respective buzzer switch 98, the lamp switch 18 and the flasher switch 74 independently of one another.

The cover 20 has the positions of the lamp switch 18, flasher switch 74 and buzzer (or siren) switch 98 printed thereon. The cover 20 further has an openings 108, 112 for accommodating and exposing the dome 78 and an annular ring 110 attached thereto which receives the buzzer module 96.

It is thought that the present invention and many of its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A card-shaped flashlight device, comprising:

(a) a battery of a generally planar configuration and having an opposite faces and a pair of electrical terminals of opposite polarities mounted on one of said opposite faces;

(b) a holder having a generally planar configuration, a front edge, a rear edge spaced from said front edge, a pair of opposite surfaces, means for receiving and holding said battery along one of said opposite surfaces of said holder and an interior edge defining a slot recessed into said holder from said front edge thereof;

(c) a reflector at least partly disposed in said slot of said holder and interfitted on said interior edge of said holder and having top and bottom portions which protrude in opposite directions outwardly beyond said opposite surfaces of said holder;

(d) a lamp mounted within said reflector;

(e) a lamp switch mounted on said holder and actuatable between on and off conditions; and (f) means for forming a lamp circuit which includes said lamp, said terminals of said battery and said lamp switch such that said lamp projects a spotlight beam shaped by said reflector in response to actuation of said lamp switch.

2. The device of claim 1 wherein said lamp is a lens end krypton bulb.

3. The device of claim 1 wherein:

said battery supplies approximately 6 volts;

said lamp utilizes approximately 4.5 volts; and said lamp circuit also includes a resistor connected in series with said battery and said lamp for stepping down said approximately 6 volts of said battery to said approximately 4.5 volts of said lamp.

4. The device of claim 3 wherein said lamp is a white LED.

5. The device of claim 1 wherein said holder includes said main panel portion having said planar configuration, said front edge, said rear edge, and said opposite surfaces of said holder.

6. The device of claim 5 wherein said holder also includes a plurality of tab portions connected to said main panel portion at locations thereon spaced apart from one another and from said front edge and extending from said main panel portion into offset positions with respect to said one of said opposite surfaces of said main panel portion so as to receive, clip and hold said battery between said main panel portion and said tab portions and generally along said one of said opposite surfaces of said main panel portion.

7. The device of claim 6 wherein said interior edge defining said slot is formed in said main panel portion and extends from said front edge toward said rear edge thereof.

8. The device of claim 7 wherein said top and bottom portions of said reflector have opposite convex configurations and are connected together and define an oval-shaped front opening, a rear end and a U-shaped peripheral channel extending between opposite ends of said front opening and said rear end of said reflector so as to interfit said U-shaped peripheral channel of said reflector over said interior edge of said main panel portion and thereby seat said reflector on said opposite surfaces of said holder along said interior edge and within said slot and through said front edge of said holder.

9. The device of claim 8 wherein said reflector also has a wall portion connected to and extending transversely between said top and bottom portions of said reflector at a location intermediately between said front opening and rear end of said reflector, said wall portion having a hole defined therethrough.

10. The device of claim 9 wherein said lamp is seated through said hole in said wall portion of said reflector and thus supported within said reflector by said wall portion, said lamp also having a pair of leads extending rearwardly from said wall portion.

11. The device of claim 1 wherein said lamp switch has a stationary contact portion and a movable contact portion adapted to be actuated to make electrical contact with said stationary contact portion.

12. The device of claim 11 wherein said stationary contact portion is a printed circuit board contact and said movable contact portion is a dome contact.

13. The device of claim 1 wherein said holder also has a continuous edge defining an opening through said main panel portion between and spaced from said slot and said rear edge thereof, said lamp switch being seated on said continuous edge and extending across said opening.

14. The device of claim 1 further comprising:

a flasher module mounted on said holder between said slot and said rear edge of said holder;

a flasher switch actuatable between on and off conditions; and means for forming a flasher circuit which includes said flasher module, said terminals of said battery and said flasher switch such that said flasher module generates a blinking light beam in response to actuation of said flasher switch.

15. The device of claim 14 wherein said flasher switch has a stationary contact portion and a movable contact portion adapted to be actuated to make electrical contact with said stationary contact portion.

16. The device of claim 15 wherein said stationary contact portion is a printed circuit board contact and said movable contact portion is a dome contact.

17. The device of claim 14 wherein said lamp switch and said flasher switch are mounted on said holder adjacent to said front edge thereof on opposite lateral sides of said slot in said holder.

18. The device of claim 14 further comprising:

a convex-shaped dome mounted on one of said opposite surfaces of said holder between said slot and said rear edge of said holder and defining a cavity between said dome and said holder and having an opening in communication with said cavity, said flasher module being disposed in said cavity and beneath said opening; and a lens mounted to said dome across said opening therein such that said blinking light of said flasher module illuminates through said lens on said dome.

19. The device of claim 14 wherein said lamp circuit is connected to said battery in parallel with said flasher circuit such that said lamp and said flasher module are operable independently of one another by actuation of said corresponding lamp switch and flasher switch independently of one another.

20. The device of claim 19 further comprising:

a buzzer module mounted on said holder between said flasher module and said rear edge of said holder;

a buzzer switch actuatable between on and off conditions; and means for forming a buzzer circuit which includes said buzzer module, said terminals of said battery and said buzzer switch such that said buzzer module generates a sound in response to actuation of said buzzer switch.

21. The device of claim 20 wherein said buzzer switch has a stationary contact portion and a movable contact portion adapted to be actuated to make electrical contact with said stationary contact portion.

22. The device of claim 21 wherein said stationary contact portion is a printed circuit board contact and said movable contact portion is a dome contact.

23. The device of claim 20 wherein said buzzer switch is mounted on said holder between said buzzer module and said rear edge of said holder.

24. The device of claim 20 wherein said buzzer circuit is connected to said battery in parallel with said flasher circuit and said lamp circuit such that said buzzer module, said lamp and said flasher module are operable independently of one another by actuation of said corresponding buzzer switch, lamp switch and flasher switch independently of one another.

25. The device of claim 1 further comprising:

a buzzer module mounted on said holder between said slot and said rear edge of said holder;

a buzzer switch actuatable between on and off conditions; and means for forming a buzzer circuit which includes said buzzer module, said terminals of said battery and said buzzer switch such that said buzzer module generates a sound in response to actuation of said buzzer switch.

26. The device of claim 25 wherein said buzzer circuit is connected to said battery in parallel with said lamp circuit such that said buzzer module and said lamp are operable independently of one another by actuation of said corresponding buzzer switch and said lamp switch independently of one another.

27. The device of claim 1 further comprising:

(g) means for enclosing said holder, said battery, said lamp switch and said reflector in a sealed pouch which permits actuation of said lamp switch from, and projection of said spotlight beam to, the exterior of said device.

28. The device of claim 27 wherein said means for enclosing includes a card adapted to have graphical design and information imprinted thereon and being folded upon itself so as to provide top and bottom sheets that overlie said opposite faces of said battery and said opposite surfaces of said holder and meet one another and are connected together to provide a folded edge, said card having an opening defined in said top and bottom sheets and intersecting said folded edge which receives said reflector such that said top and bottom portions of said reflector project respectively above and below said top and bottom sheets of said card.

29. The device of claim 28 wherein said means for enclosing further includes an outer protective cover made of transparent material which extends over said top and bottom sheets of said card and said top and bottom portions of reflector so as to provide a sealed pouch which overlies and encloses said battery, said holder, said reflector, said lamp, said lamp switch, and said card.

30. A card-shaped flashlight device, comprising:

(a) a battery of a generally planar configuration and having an opposite faces and a pair of electrical terminals of opposite polarities mounted on one of said opposite faces;

(b) a holder having a generally planar configuration, a front edge, a rear edge spaced from said front edge, a pair of opposite surfaces, and means for receiving and holding said battery along one of said opposite surfaces of said holder;

(c) a lamp module mounted on said front edge of said holder;

(d) a lamp switch mounted on said holder and actuatable between on and off conditions;

(e) means for forming a lamp circuit which includes said lamp module, said terminals of said battery and said lamp switch such that said lamp module projects a light beam in response to actuation of said lamp switch;

(f) a flasher module mounted on said holder between said lamp module and said rear edge of said holder;

(g) a flasher light switch actuatable between on and off conditions; and (h) means for forming a flasher circuit which includes said flasher module, said terminals of said battery and said flasher switch such that said flasher module generates a blinking light beam in response to actuation of said flasher switch.

31. The device of claim 30 wherein said lamp switch and said flasher switch are mounted on said holder adjacent to said front edge thereof on opposite lateral sides of said light module.

32. The device of claim 30 further comprising:

a convex-shaped dome mounted on said holder and defining a cavity between said dome and said holder and having an opening in communication with said cavity, said flasher module being disposed in said cavity and beneath said opening; and a lens mounted to said dome across said opening therein such that said blinking light of said flasher module illuminates through said lens on said dome.

33. The device of claim 30 wherein said lamp circuit is connected to said battery in parallel with said flasher circuit such that said lamp module and said flasher module are operable independently of one another by actuation of said corresponding lamp switch and flasher switch independently of one another.

34. The device of claim 30 further comprising:

(i) a buzzer module mounted on said holder between said flasher module and said rear edge of said holder;

(j) a buzzer switch actuatable between on and off conditions; and (k) means for forming a buzzer circuit which includes said buzzer module, said terminals of said battery and said buzzer switch such that said buzzer module generates a sound in response to actuation of said buzzer switch.

35. The device of claim 34 wherein said buzzer switch is mounted on said holder between said buzzer module and said rear edge of said holder.

36. The device of claim 34 wherein said buzzer circuit is connected to said battery in parallel with said flasher circuit and said lamp circuit such that said buzzer module, said lamp module and said flasher module are operable independently of one another by actuation of said corresponding buzzer switch, lamp switch and flasher switch independently of one another.

37. A card-shaped flashlight device, comprising:

(a) a battery of a generally planar configuration and having an opposite faces and a pair of electrical terminals of opposite polarities mounted on one of said opposite faces;

(b) a holder having a generally planar configuration, a front edge, a rear edge spaced from said front edge, a pair of opposite surfaces, and means for receiving and holding said battery along one of said opposite surfaces of said holder;

(c) a light module mounted on said front edge of said holder;

(d) a lamp switch mounted on said holder and actuatable between on and off conditions;

(e) means for forming a lamp circuit which includes said lamp module, said terminals of said battery and said lamp switch such that said lamp module projects a light beam in response to actuation of said lamp switch;

(f) a buzzer module mounted on said holder between said light module and said rear edge of said holder;

(g) a buzzer switch actuatable between on and off conditions; and (h) means for forming a buzzer circuit which includes said buzzer module, said terminals of said battery and said buzzer switch such that said buzzer module generates a sound in response to actuation of said buzzer switch.

38. The device of claim 37 wherein said buzzer circuit is connected to said battery in parallel with said lamp circuit such that said buzzer module and said lamp module are actuatable by said corresponding buzzer switch and said lamp switch independently of one another.

39. The device of claim 38 wherein said buzzer switch is mounted on said holder between said buzzer module and said rear edge of said holder.

40. A card-shaped flashlight device, comprising:

(a) a holder;

(b) a lamp module mounted on said holder;

(c) a flasher light module mounted on said holder;

(d) a buzzer module mounted on said holder;

(e) a planar battery attached to said holder for powering said lamp module, buzzer module and flasher module; and (f) lamp, flasher and buzzer circuits which respectively include a lamp switch and said lamp module, a buzzer switch and said buzzer module and a flasher switch and said flasher module being connected to said battery in parallel relationships with one another such that said lamp module, said buzzer module and said flasher module are operable independently of one another by actuation of said corresponding lamp switch, buzzer switch and flasher switch independently of one another.

41. A card-shaped flashlight device, comprising:

(a) a battery of a generally planar configuration and having an opposite faces and a pair of electrical terminals of opposite polarities mounted on one of said opposite faces;

(b) a holder having a generally planar configuration, a front edge, a rear edge spaced from said front edge, a pair of opposite surfaces, and means for receiving and holding said battery along one of said opposite surfaces of said holder;

(c) a lamp module mounted on said front edge of said holder;

(d) a lamp switch mounted on said holder and actuatable between on and off conditions;

(e) means for forming a lamp circuit which includes said lamp module, said terminals of said battery and said lamp switch such that said lamp module projects a light beam in response to actuation of said lamp switch;

(f) a flasher module mounted on said holder;

(g) a flasher switch actuatable between on and off conditions;

(h) means for forming a flasher circuit which includes said flasher module, said terminals of said battery and said flasher switch such that said flasher module generates a blinking light beam in response to actuation of said flasher light switch;

(i) a buzzer module mounted on said holder;

(j) a buzzer switch actuatable between on and off conditions; and (k) means for forming a buzzer circuit which includes said buzzer module, said terminals of said battery and said buzzer switch such that said buzzer module generates a sound in response to actuation of said buzzer switch, said buzzer circuit being connected to said battery in parallel with said flasher circuit and said lamp circuit such that said buzzer module, said lamp module and said flasher module are operable independently of one another by actuation of said corresponding buzzer switch, lamp switch and flasher switch independently of one another.

42. The device of claim 41 wherein:

said battery supplies approximately 6 volts;

said lamp module utilizes approximately 4.5 volts; and said lamp circuit also includes a resistor connected in series with said battery and lamp module for stepping down said approximately 6 volts of said battery to said approximately 4.5 volts of said lamp module.

43. The device of claim 41 wherein said flasher module is mounted on said holder between said lamp module and said rear edge of said holder.

44. The device of claim 43 wherein said buzzer module is mounted on said holder between said flasher module and said rear edge of said holder.

45. The device of claim 44 wherein said buzzer switch is mounted on said holder between said buzzer module and said rear edge of said holder.

46. The device of claim 41 wherein said lamp switch and said flasher switch are mounted on said holder adjacent to said front edge thereof on opposite lateral sides of said lamp module.

47. The device of claim 41 further comprising:

a convex-shaped dome mounted on said holder and defining a cavity between said dome and said holder and having an opening in communication with said cavity, said flasher module being disposed in said cavity and beneath said opening; and a lens mounted to said dome across said opening therein such that said blinking light of said flasher module illuminates through said lens on said dome.

* * * * *